US009857126B2

(12) United States Patent
Kim

(10) Patent No.: US 9,857,126 B2
(45) Date of Patent: Jan. 2, 2018

(54) RADIATOR FOR VEHICLE

(71) Applicant: Hyundai Motor Company, Seoul (KR)

(72) Inventor: Kyung Tae Kim, Ansan-si (KR)

(73) Assignee: Hyundai Motor Company, Seoul (KR)

( * ) Notice: Subject to any disclaimer, the term of this patent is extended or adjusted under 35 U.S.C. 154(b) by 171 days.

(21) Appl. No.: 14/859,036

(22) Filed: Sep. 18, 2015

(65) Prior Publication Data

US 2016/0237878 A1 Aug. 18, 2016

(30) Foreign Application Priority Data

Feb. 16, 2015 (KR) ..... 10-2015-0023461

(51) Int. Cl.
*F28D 1/053* (2006.01)
*F28D 1/04* (2006.01)
*F01P 3/18* (2006.01)

(52) U.S. Cl.
CPC ..... *F28D 1/0408* (2013.01); *F01P 3/18* (2013.01); *F28D 1/05358* (2013.01); *F01P 2003/182* (2013.01); *F01P 2003/185* (2013.01)

(58) Field of Classification Search
CPC ..... F28F 9/0209; F28F 9/0212; F28F 9/028; F28F 9/262; F28F 2009/0287; F28D 1/0408; F28D 1/0443; F28D 1/05358; F28D 1/0426; F01P 3/18; F01P 2003/182; F01P 2003/185
See application file for complete search history.

(56) References Cited

U.S. PATENT DOCUMENTS 5,875,834 A * 3/1999 Brooks ..... F28D 1/0333 165/11.1
6,089,039 A * 7/2000 Yamauchi ..... F25B 6/04 165/113
9,638,470 B2 * 5/2017 Dziubinschi ..... F28D 1/05316
2005/0006068 A1 * 1/2005 Desai ..... F28D 1/0443 165/140
2006/0113068 A1 * 6/2006 Desai ..... F28D 1/0417 165/140
2006/0201198 A1 * 9/2006 Nishino ..... F25B 39/028 62/525
2008/0047687 A1 * 2/2008 Leitch ..... F28D 1/0443 165/70
2012/0247742 A1 * 10/2012 Mizuno ..... F28F 9/0209 165/173
2015/0176924 A1 * 6/2015 Hu ..... F28F 9/002 165/67

FOREIGN PATENT DOCUMENTS

DE 10328458 A1 * 1/2005 ..... F28D 1/0443
DE EP 2945217 A1 * 11/2015 ..... F28D 1/05383
(Continued)

*Primary Examiner* — Devon Russell
(74) *Attorney, Agent, or Firm* — Morgan, Lewis & Bockius LLP

(57) ABSTRACT

A radiator which is disposed in front of a cooling fan may include a main heat-radiating portion to cool a high temperature coolant, an auxiliary heat-radiating portion to cool a coolant that is a relatively lower temperature coolant than the coolant passing through the main heat-radiating portion, and an insulating plate that prevents heat from being exchanged between the main heat-radiating portion and the auxiliary heat-radiating portion, in which the auxiliary heat-radiating portion is positioned at a center portion in front of the cooling fan.

5 Claims, 2 Drawing Sheets

(56) References Cited

FOREIGN PATENT DOCUMENTS

| | | | | | | |
|---|---|---|---|---|---|---|
| FR | WO 2008071511 | A1 | * | 6/2008 | ..... | F01P 7/165 |
| JP | 56127187 | A | * | 10/1981 | ..... | F28D 1/0408 |
| JP | 04369396 | A | * | 12/1992 | ..... | F28D 1/0443 |
| JP | 2004077114 | A | * | 3/2004 | ..... | F28D 1/0443 |
| JP | 2004347160 | A | * | 12/2004 | ..... | F28D 1/0443 |
| JP | 2006242432 | A | * | 9/2006 | ..... | F28D 1/0443 |
| JP | 2007040605 | | * | 2/2007 | | |
| JP | 2007040605 | A | * | 2/2007 | ..... | F28D 1/0443 |
| JP | 2008-128030 | A | | 6/2008 | | |
| KR | 10-2011-0133155 | A | | 12/2011 | | |
| KR | WO 2012134089 | A2 | * | 10/2012 | ..... | F28F 9/187 |
| KR | 10-2013-0004988 | A | | 1/2013 | | |
| KR | 10-1326510 | B1 | | 11/2013 | | |
| SE | WO 2015070897 | A1 | * | 5/2015 | ..... | A47L 15/483 |
| WO | WO 2007079140 | A2 | * | 7/2007 | ..... | F28D 1/0443 |

* cited by examiner

RADIATOR FOR VEHICLE

CROSS-REFERENCE TO RELATED APPLICATION

The present application claims priority to Korean Patent Application No. 10-2015-0023461 filed Feb. 16, 2015, the entire contents of which is incorporated herein for all purposes by this reference.

BACKGROUND OF THE INVENTION

Field of the Invention

The present invention relates to a vehicle radiator. More particularly, the present invention relates to a radiator for a vehicle that improves cooling efficiency and performance by positioning an auxiliary heat-radiating portion between a pair of main heat-radiating portions and connecting the pair of main heat-radiating portions each other through an ejector.

Description of Related Art

Generally, mixture of fuel and air is injected into a cylinder of an engine and pressure produced when the mixture is burnt is delivered to a driving wheel in a vehicle. Thereby, the vehicle runs. The engine is provided with a cooling apparatus such as a water jacket for cooling the engine of high temperature due to combustion of the mixture. And, a radiator is generally provided in order to cool coolant which circulates the cooling apparatus such as the water jacket.

Recently, an environmentally-friendly vehicle such as a hybrid vehicle and an electric vehicle using an electric motor as a driving source is released. And plurality of electrical equipment may be installed therein. For example, the electric motor, an inverter, a motor controller, and other high voltage components for running vehicle may be installed, and these electrical equipment devices require an individual cooling system so as to prevent heat damage and maintain durability. Commonly, a cooling condition required of the electrical equipment is different from the engine. Thus, a separate radiator is installed besides a normal radiator.

Meanwhile, besides the environmentally-friendly vehicle, a cooling condition required of an intercooler installed in a vehicle with a turbocharger is different from the engine. Thereby, a separate radiator is installed to cool the intercooler together with the normal radiator.

As described above, the environmentally-friendly vehicle and the vehicle with the turbocharger have the individual radiator each. The individual radiator is disposed downward or frontward or rearward of a heat-exchanger.

However, if the individual radiator is provided at downward or frontward or rearward of the heat-exchanger, then 1) to absorb a shock at a front portion of vehicle may be difficult due to compact layout, and 2) a fan motor size is larger so as to reduce an air resistance generated due to interference between the air should, and 3) A method of assembling the radiator into radiator is complicated, thus time and a number of work procedures of the assembly is increased.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a radiator for vehicle having advantages of increasing performance and efficiency by positioning an auxiliary heat-radiating portion between a pair of main heat-radiating portions and connecting the pair of main heat-radiating portions to each other through an ejector.

According to various aspects of the present invention, a radiator which is disposed in front of a cooling fan may include a main heat-radiating portion to cool a high temperature coolant, an auxiliary heat-radiating portion to cool a coolant that is a relatively lower temperature coolant than the coolant passing through the main heat-radiating portion, and an insulating plate that prevents heat from being exchanged between the main heat-radiating portion and the auxiliary heat-radiating portion, in which the auxiliary heat-radiating portion is positioned at a center portion in front of the cooling fan.

The main heat-radiating portion may include an upper main heat-radiating portion disposed at an upper side of the auxiliary heat-radiating portion, and a lower main heat-radiating portion disposed at a lower side of the auxiliary heat-radiating portion, in which the radiator may further include a first main tank disposed at the upper main heat-radiating portion so as to receive the coolant from the upper main heat-radiating portion, and a second main tank disposed at the lower main heat-radiating portion so as to receive the coolant from the first main tank, and the coolant passing through the first main tank is transferred to the second main tank.

The radiator may further include an ejector configured to increase a flow velocity of the coolant that is transferred from the first main tank into the second main tank by fluidly communicating the first main tank with the second main tank.

The ejector may include an operational nozzle portion which is disposed at an inside of the first main tank such that the coolant is supplied thereinto, and a main nozzle portion combined with the operational nozzle portion, configured to transfer the coolant supplied from the operational nozzle portion to the second main tank.

An inflow hole may be formed at a first side of the operational nozzle portion such that the coolant is flowed thereinto, an outflow hole may be formed at a second side of the operational nozzle portion such that the coolant is discharged into the main nozzle portion, and a cross-section of the inflow hole is formed to be larger than a cross-section of the outflow hole.

The radiator may further include an auxiliary tank disposed at one side of the auxiliary heat-radiating portion so as to receive the coolant from the auxiliary heat-radiating portion, a first baffle that partitions the first main tank and the first auxiliary tank so as to cut off fluid-communication between the first main tank and the auxiliary tank to each other, and a second baffle that partitions the auxiliary tank and the second main tank so as to cut off fluid-communication between the auxiliary tank and the second main tank to each other, in which at least one penetration hole is formed at one side of the main nozzle portion in order to receive the coolant from the main tank.

The at least one penetration hole that is positioned adjacent to the first baffle may be formed apart from another penetration hole along a circumference of the main nozzle portion.

A first insertion hole opened in up and down directions may be formed in the first baffle, a second insertion hole opened in the up and down directions may be formed in the second baffle, and the ejector may be press-fitted in the first and second insertion holes while passing through the first and second baffles.

As described above, according to various embodiments of the present invention, a collision space of the front side of the vehicle may be secured by disposing a plurality of cooling system on a same plane, the radiator may be down-sized, and fuel consumption may be enhanced due to reducing the air resistance. In addition, it prevents overcooling of the auxiliary heat-radiating portion in a condition of high-speed driving or a low-temperature external environment by positioning the auxiliary heat-radiating portion between a pair of main heat-radiating portions. Moreover, a tank could be down-sized by connecting the pair of main heat-radiating portions by the ejector.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
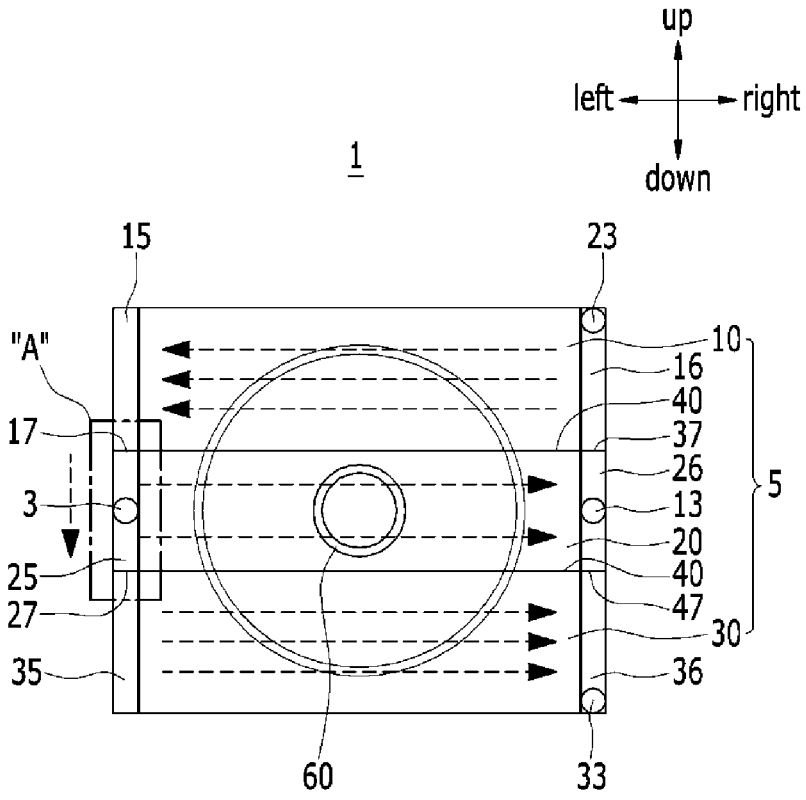
FIG. 1 is a schematic diagram of an exemplary radiator according to the present invention.
Figure 2:
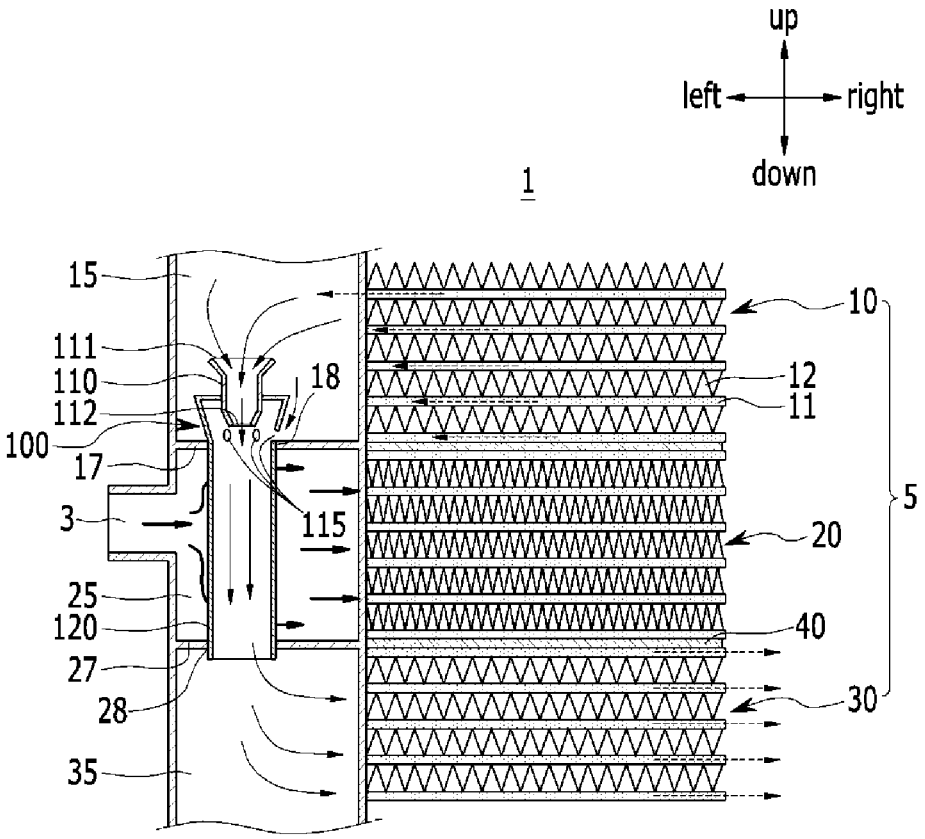
FIG. 2 is enlarged schematic diagram of portion "A" of FIG. 1.

FIG. 1 is a schematic diagram of a radiator according to various embodiments of the present invention, and FIG. 2 is enlarged schematic diagram of part A of FIG. 1.

According to various embodiments of the present invention, a radiator 1 cools a coolant circulated an internal combustion engine or electrical equipment through heat-exchange with outdoor air at the front of a vehicle. As shown in FIG. 2, such the radiator 1 includes a main heat-radiating portion 5, an auxiliary heat-radiating portion 20, an insulating plate 40, heat diffusion tubes 11, heat diffusion fins 12, and ejector 100.

The main heat-radiating portion 5 cools the coolant circulated through high temperature devices such as an internal combustion engine. A plurality of main heat-radiating portions 5 may be provided and the main heat-radiating portions 5 may be double-layered with an upper main heat-radiating portion 10, and a lower heat-radiating portion 30.

The upper main heat-radiating portion 10 is disposed at an upper side based on a height direction of the vehicle, a first main tank 15 and a third main tank 16 may be provided at both sides thereof. The first main tank 15 is disposed in a left side of the upper main heat-radiating portion 10 based on FIG. 1 and FIG. 2, the third main tank 16 is disposed at a right side thereof. In the third main tank 16, a first inflow port 23 that receives high temperature coolant circulated to the engine is formed.

As depicted by an arrow in FIG. 1, the coolant that is supplied into the first inflow port 23 is exhausted to the first main tank 15 passing through the upper main heat-radiating portion 10.

This lower main heat-radiating portion 30 is disposed at a down side of the upper main radiating portion 15. A second main tank 35 is provided at a left side of the lower heat-radiating 30 based on FIG. 1, and a fourth main tank 36 is provided at a right side thereof. In the fourth main tank 16, a first outflow port 33 that exhausts the coolant passing through the main heat-radiating portion 5 is formed. That is, the coolant that is supplied into the second tank 35 may be exhausted through the first outflow port 33 via the lower main heat-radiating portion 30.

The auxiliary heat-radiating portion 20 may cool a coolant that has different requirements from the coolant passing through the main heat-radiating portion 5. In other words, the coolant passing through the auxiliary heat-radiating portion 20 may be circulated to devices such as electrical equipment or an intercooler that have different required cooling condition from the internal combustion engine. A passage passing through the auxiliary heat-radiating portion 20 is separated from the main heat-radiating portion 5, thereby independent cooling circuit including the auxiliary heat-radiating portion 20 may be provided.

Meanwhile, the auxiliary heat-radiating portion 20 is integrally assembled to the main heat-radiating portion 10 on the same plane in order to configure one heat exchanger, and it is disposed between main heat-radiating portions 5 based on the height direction. That is, the auxiliary heat-radiating portion 20 may be disposed between the upper main heat-radiating portion 10 and the lower main heat-radiating portion 30 so as to cross a center of the main heat-radiating portions 5. When the auxiliary heat-radiating portion 20 is disposed the center of the main heat-radiating portions 5, then an effective area of air supplied from cooling fan 60 positioned backward of the radiator 1 may be large, thereby more air may be supplied into the radiator 1. Thus, the cooling efficiency of the radiator 1 may be improved.

If, the auxiliary heat-radiating portion 20 is disposed at a lower part of the radiator 1, while the vehicle is placed at a condition of high-speed driving or a low-temperature external environment state, a substantial amount of low temperature air may be supplied into the auxiliary heat-radiating portion 20 through a bumper hole mounted at the front of the vehicle. Therefore, the coolant passing through the auxiliary heat-radiating portion 20 may be over cooled.

To prevent this problem, according to various embodiments of the present invention, the auxiliary heat-radiating portion 20 is disposed between the upper main heat-radiating portion 10 and the lower main heat-radiating portion 30 based on a height direction.

The auxiliary heat-radiating portion 20 has a first auxiliary tank 25 and a second auxiliary tank 26 at both sides thereof. The first auxiliary tank 25 is disposed at the left side of the auxiliary heat-radiating portion 20 of the drawing. The second auxiliary tank 26, the first main tank 15, and the second main tank 35 may be configured as one tank. A first baffle 17 that partitions the first main tank 15 and the first auxiliary tank 25 is disposed at the upper side of the first auxiliary tank 25, and a second baffle 27 that partitions the second main tank 35 and the first auxiliary tank 25 is disposed at the lower side of the first auxiliary tank 25.

A first insertion hole 18 opened in an up and down direction is formed at the first baffle 17, a second insertion hole 28 opened in the up and down direction is formed at the second baffle 27, the ejector 100 may be mounted by being inserted through the first insertion hole 18 and the second insertion hole 28.

The second auxiliary tank 26 is disposed at the right side of the auxiliary heat-radiating portion 20 in the drawing. And the second auxiliary tank 26, the third main tank 16, and the fourth main tank 36 may be configured as one tank. A third baffle 37 that partitions the third main tank 16 and the second auxiliary tank 26 is disposed at the upper side of the second auxiliary tank 26, and a fourth baffle 47 that partitions the fourth main tank 36 and the second auxiliary tank 26 is disposed at the lower side of the second auxiliary tank 26.

The insulating plate 40 is provided for partitioning the main heat-radiating portion 5 and the auxiliary heat-radiating portion 20, and it blocks heat exchange between the main heat-radiating portion 10 and an auxiliary heat-radiating portion 20. The insulating plate 40 is extended both sides thereof and is integrally formed with the each baffle 17, 27, 37, and 47. A cooling circuit passing through the main heat-radiating portion 5 is separated from a cooling circuit passing through the auxiliary heat-radiating portion 20 by the insulating plate 40 and the each baffle 17, 27, 37, and 47.

The heat diffusion tube 11 is disposed in plural in a height direction, both side ends are fixed between the first main tank 15 and the third main tank 16, between the second main tank 35 and the fourth main tank 36, and between the first auxiliary tank 25 and the second auxiliary tank 26 so as to form the heat exchange passage.

The heat diffusion fin 12 is disposed between the plurality of diffusion tubes 11 so as to exchange heat with outdoor air.

The ejector 100 is configured to communicate the first main tank 15 with the second main tank 35 so as to increase the velocity of the coolant passing therethrough. The ejector 100 may be pressed and installed in the first, second insertion holes 18, and 28 to penetrate the first baffle 17 and the second baffle 27 in order to easily assemble and dismantle.

The ejector 100 includes an operational nozzle portion 110, and a main nozzle portion 120.

The operational nozzle portion 110 is disposed inside of the first main tank 15, formed in a cylindrical shape, and the coolant may be supplied into the operational nozzle portion 110 from the first main tank 15. An inflow hole 111 is formed at one side of the operational nozzle portion 110 such that the coolant is flowed in, an outflow hole 112 is formed at the other side of the operational nozzle portion 110 such that the coolant flowing through the inflow hole 111 is discharged into the main nozzle portion 120.

A cross-section of the inflow hole 111 is formed to be larger than a cross-section of the outflow hole 112. Therefore, the coolant supplied into the inflow hole 111 is flowed into the inside of the operational nozzle portion 110 which becomes gradually narrower. Thus, the velocity of the coolant becomes faster. Accordingly, a flow rate of the coolant discharged from the operational nozzle portion 110 into the main nozzle portion 120 may be increased. In addition, the inflow hole 111 may be formed to face the upper side based on the height direction. Thus, the coolant supplied into the inflow hole 111 is affected by gravity in a height direction, the coolant may rapidly pass the operational nozzle portion 110.

The main nozzle portion 120 is combined with the operational nozzle portion 110, formed in a cylindrical shape, and is extended from inside of the first main tank 15 to the second main tank 35. Thus, the coolant supplied from the operational nozzle 110 may be transferred into the second main tank 35.

At least one penetration hole 115 is formed at a side surface of the main nozzle portion 120 such that the coolant is flowed from the first main tank 15. The penetration hole 115 may be formed to be spaced apart from each other along a circumference of the main nozzle portion 120, and the penetration hole is adjacent to the first baffle 17. The coolant flowing into the penetration hole 115 and the coolant passing through the outflow 112 join together, and the coolant joined may pass the main nozzle portion 120 rapidly and transferred into the second main tank 35.

In addition, a center cross-section area of the main nozzle portion 120 may be formed to be smaller based on the height direction. In other words, the main nozzle portion is formed in a venturi tube shape, and the velocity of the coolant passing through the main nozzle portion 120 may be increased due to this shape. Therefore, the coolant may be effectively transferred from the first main tank 15 into the second main tank 25 even if each size of the first, second main tank 15, 25 is rather small.

As described above, according to various embodiments of the present invention, a collision space of the front side of the vehicle may be secured by disposing a plurality of cooling system on a same plane, the radiator may be down-sized, and fuel consumption may be enhanced due to reducing the air resistance. In addition, it prevents overcooling of the auxiliary heat-radiating portion in a condition of high-speed driving or a low-temperature external environment by positioning the auxiliary heat-radiating portion between a pair of main heat-radiating portions. Moreover, a tank could be down-sized by connecting the pair of main heat-radiating portions by the ejector.

The ejector 100 according to various embodiments of the present invention is one example of various ejectors, a spirit of the present invention is not restrictively applied to the ejector 100 described in the present specification but various ejectors may be applied to radiator.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A radiator which is disposed in front of a cooling fan, the radiator comprising:

a main heat-radiating portion to cool a high temperature coolant;

an auxiliary heat-radiating portion to cool a coolant that is a relatively lower temperature coolant than the coolant passing through the main heat-radiating portion; and an insulating plate that prevents heat from being exchanged between the main heat-radiating portion and the auxiliary heat-radiating portion, wherein the auxiliary heat-radiating portion is positioned at a center portion in front of the cooling fan, wherein the main heat-radiating portion includes:

an upper main heat-radiating portion disposed at an upper side of the auxiliary heat-radiating portion; and a lower main heat-radiating portion disposed at a lower side of the auxiliary heat-radiating portion, wherein the radiator further includes:

a first main tank disposed at the upper main heat-radiating portion so as to receive the coolant from the upper main heat-radiating portion; and a second main tank disposed at the lower main heat-radiating portion so as to receive the coolant from the first main tank, wherein the coolant passing through the first main tank is transferred to the second main tank, an ejector configured to increase a flow velocity of the coolant that is transferred from the first main tank into the second main tank by fluidly communicating the first main tank with the second main tank, and wherein the ejector includes:

an operational nozzle portion which is disposed at an inside of the first main tank such that the coolant is supplied thereinto; and a main nozzle portion combined with the operational nozzle portion, configured to transfer the coolant supplied from the operational nozzle portion to the second main tank.

2. The radiator of claim 1, wherein an inflow hole is formed at a first side of the operational nozzle portion such that the coolant flows thereinto, an outflow hole is formed at a second side of the operational nozzle portion such that the coolant is discharged into the main nozzle portion, and a cross-section of the inflow hole is formed to be larger than a cross-section of the outflow hole.

3. The radiator of claim 2, further including:

an auxiliary tank disposed at one side of the auxiliary heat-radiating portion so as to receive the coolant from the auxiliary heat-radiating portion;

a first baffle that partitions the first main tank and the first auxiliary tank so as to cut off fluid-communication between the first main tank and the auxiliary tank to each other; and a second baffle that partitions the auxiliary tank and the second main tank so as to cut off fluid-communication between the auxiliary tank and the second main tank to each other, wherein at least one penetration hole is formed at one side of the main nozzle portion in order to receive the coolant from the first main tank.

4. The radiator of claim 3, wherein the at least one penetration hole is positioned adjacent to the first baffle and is formed apart from another penetration hole along a circumference of the main nozzle portion.

5. The radiator of claim 4, wherein a first insertion hole opened in up and down directions is formed in the first baffle, a second insertion hole opened in the up and down directions is formed in the second baffle, and the ejector is press-fitted in the first and second insertion holes while passing through the first and second baffles.

* * * * *